United States Patent [19]

Adimari et al.

[11] B 3,981,244

[45] Sept. 21, 1976

[54] PYRAMID PROJECTILE PAYLOAD EJECTION DEVICE

[75] Inventors: Louis J. Adimari, Lake Hiawatha; George D. Dusoe, Oak Ridge, both of N.J.

[73] Assignee: The United States of America as represented by the Secretary of the Army, Washington, D.C.

[22] Filed: Nov. 2, 1973

[21] Appl. No.: 412,068

[44] Published under the second Trial Voluntary Protest Program on January 13, 1976 as document No. B 412,068.

Related U.S. Application Data

[63] Continuation-in-part of Ser. No. 229,847, Feb. 28, 1972, abandoned.

[52] U.S. Cl. ..... 102/69

[51] Int. Cl.[2] ..... F42B 13/50

[58] Field of Search..... 102/34.4, 35.6, 37.6, 102/49.4, 65, 67, 69, 90

[56] References Cited

UNITED STATES PATENTS

| | | | |
|---|---|---|---|
| 2,398,740 | 4/1946 | Halvey | 102/37.6 |
| 3,404,630 | 10/1968 | Grandy | 102/90 |
| 3,460,507 | 8/1969 | Little et al. | 102/65 |
| 3,677,182 | 7/1972 | Peterson | 102/90 |

FOREIGN PATENTS OR APPLICATIONS

| | | | |
|---|---|---|---|
| 859,382 | 6/1940 | France | 102/35.6 |

*Primary Examiner*—Verlin R. Pendegrass

*Attorney, Agent, or Firm*—Nathan Edelberg; A. Victor Erkkila; Thomas R. Webb

[57] ABSTRACT

In a projectile wherein a payload is to be ejected at a selected point along the trajectory of the projectile, an improvement for increasing the payload through the loading of the projectile volume encompassed by the ogive portion thereof. The projectile is provided with an expulsion charge cup disposed proximate the nose for supplying an explosively expanding gas to eject the payload carried within the center and rear portions of the projectile housing. Intermediate the expulsion cup and the primary payload and within the projectile ogive there is disposed for sliding movement a pusher assembly which in one embodiment is in the form of an open cup with the closed end opposite the expulsion charge and carrying an "O" ring between its outer surface and the inner surface of the projectile housing. In the second embodiment the cup structure is in the form of two parts. A hollow circular cylinder partially closed at one end and having a pusher plate closing the partially open end of the cylinder and being formed with an annular shoulder abutting the inner peripheral surface defining the opening in the partially closed end. In both embodiments the forward inner surface of projectile housing carries an inwardly directed stop for terminating the movement of said expulsion mechanism.

9 Claims, 5 Drawing Figures

PYRAMID PROJECTILE PAYLOAD EJECTION DEVICE

The invention described herein may be manufactured, used and licensed by or for the Government for governmental purposes without the payment to us of any royalty thereon.

This application is a continuation-in-part of an application of Louis J. Adimari and George D. Dusoe for Pyramid Projectile Payload Ejection Device, Ser. No. 229,847, filed Feb. 28, 1972, and now abandoned.

BACKGROUND OF THE INVENTION

The present invention relates to a payload projectile system and more particularly to a structural arrangement for increasing the load to be carried and an ejection mechanism wherein the payload is dispensed at a selected point along the projectile trajectory.

In the field of ballistic projectiles, carrying payloads, to be dropped prior to impact, it has been the general practice to employ standard forms of load packaging wherein only the interior volume exclusive of that encompassed by the ogive portion has been employed to house the payload. Such arrangements have been unsatisfactory in that a substantial portion of the projectile volume has been unutilized thereby limiting the cargo carrying capability, increasing the delivery cost, as well as requiring excessive parasitic hardware all of which hinder proper air detonation. The instant invention overcomes these problems while filling the present need.

SUMMARY OF THE INVENTION

The general purpose of this invention is to provide an ejection or expulsion system for a payload projectile that has all the advantages of similarly employed prior art devices and has none of the above described disadvantages. To attain this, the present invention provides a unique structural arrangement wherein the internal ogive portion of the projectile intermediate the rear primary payload and the expulsion charge cup is provided with a cup-like ejection member whose closed end faces the expulsion charge and peripheral wall conforms to the internal wall of the housing of the projectile with the forward open portion having an outwardly directed flange for sliding abutment with the inner projectile wall forward of the ogive. The ejection member may be unitary wherein only one sealing "O" ring is required or partially open at its rear portion and closed by a pusher plate with two "O" rings for confining the gases generated by the expulsion charge. The base of the projectile housing carries an internally extending stop member for terminating the rearward motion of the pusher assembly. By filling the ejection member with an additional payload the previously empty ogive portion is thereby more fully utilized.

An object of the present invention is to provide a dispensing type payload projectile wherein a substantial portion of the ogive volume is utilized for cargo.

Another object is the provision of an efficient, low cost, high capacity projectile wherein the parasitic hardware is minimized and a simple pusher assembly is employed.

Still another object is to provide a direct pusher assembly for expulsion of the projectile payload including that portion situated within the projectile ogive.

Other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Figure 1:
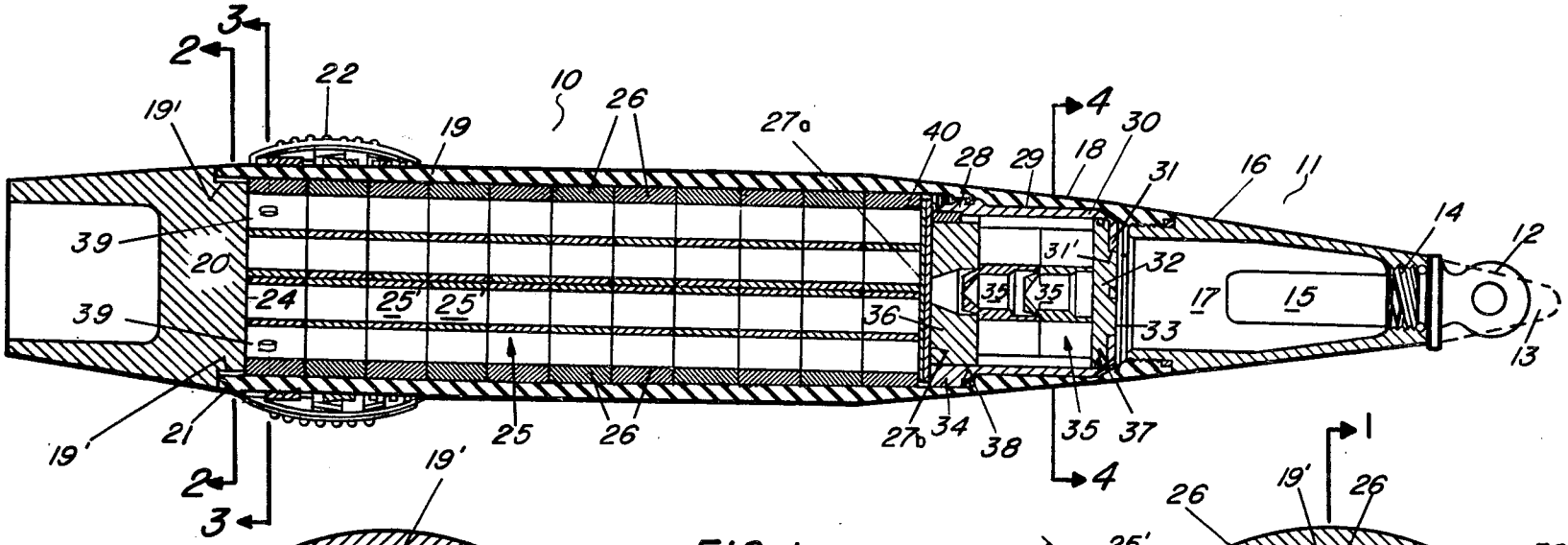
FIG. 1 is an axial sectional view, taken on line 1—1 of FIG. 3, of an embodiment made in accordance with the principle of this invention.

In the illustrated embodiment of FIGS. 1–4, the projectile or round 10 is generally cylindrical in cross section with the forward or nose end 11 converging toward a point and terminating in either a lifting plug 12 for handling or a fuze section 13 (dotted) for actual firing, either of which are threaded into the mating internal threads 14 of the projectile. Also supported internally by this threaded section is the ejection charge cup 15 which is confined within the forward ogive 16 (plenum 17). Broadly defined, the ogive of the projectile includes all that forward portion which converges inwardly and in addition to the forward ogive 16 it encompasses the ogive section 18. Thus, the pyramid projectile housing 19 with its integral ogive section 18, the forward ogive 16 threaded thereto, the plug 12 or fuze 13 and the base 20 constitute the round. The housing is essentially a hollow cylinder closed at one end by base 20 which is formed with a large central recess for receiving propellant therein and closed at the other end by forward ogive 16 and plug 12. The base is releasably secured to the housing by a plurality of shear pins 21 (FIG. 2) which extend through the housing wall 19 into the base 20. The rear portion of the housing is provided with an annular peripheral rotating band assembly 22. The band assembly 22 produces the spin imparted to the projectile as it traverses the gun barrel.

Figure 3:
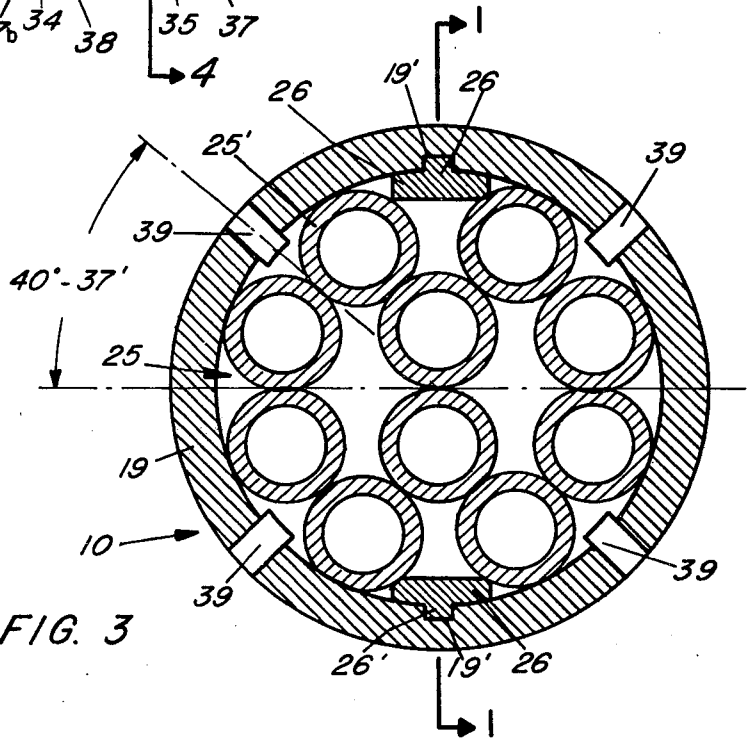
FIGS. 2, 3 and 4 are enlarged transverse sectional views taken on lines 2—2, 3—3, and 4—4, respectively, of FIG. 1.
Figure 2:
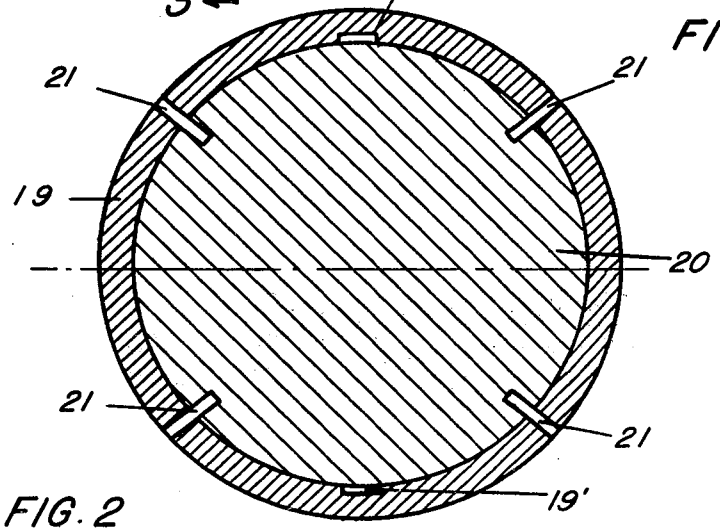

In front of the rear wall 24 of the base 20 are stacked the elements 25' of a compartmentalized payload 25, as shown in FIGS. 1 and 3. The payload elements 25', which are shown as axially-aligned short hollow cylinders for simplicity, may be shrapnel or explosive devices such as grenades. The elements 25' may be held in a predetermined orientation, and axially guided during ejection of the payload 25 from the housing 19, by at least one axial series of spacer elements 26 which have ribs 26' slidably engaging an axial groove 19' in the housing wall. The payload 25 and spacers 26 extend forwardly to approximately the integral ogive section 18 where the housing 19 is closed by a shim **27*a* and a take-up pad 27*b*.**

Figure 4:
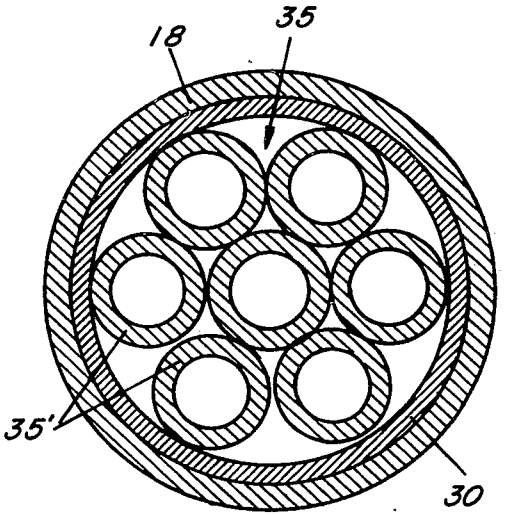

The inner peripheral wall of ogive section 18 has the same diameter at its rear end 28 as the housing 19 and a reduced diameter at 29 extending to almost its opposite end. Disposed within the ogive section 18 is a pusher assembly that includes a cup member 30 which is entirely open across take-up pad **27*b* and partially closed at its other end by an annular portion 31 leaving a reduced-diameter central circular opening 31'. The opening 31' is closed by pusher plate 32 which is essentially a circular disc with a forwardly-facing central boss 33 that fills the opening 31' when the forward surface of the plate abuts the annular portion 31. This arrangement permits the entire pusher assembly to move rearward through the projectile housing 19 with the outer enlarged peripheral surface 34 of the cup riding against the inner surface of housing 19 and provide a bearing surface therethrough. An additional payload 35 is carried within the cup member 30 and the elements 35' thereof may be stacked in the cup member with the rear elements supported by a holder disc 36. The payload elements 35' may be formed with plug and socket ends which engage sockets and plugs on axially adjacent elements 35' or similar sockets in the holder disc 36, as shown in FIG. 4. The main payload elements 25' may be similarly formed. Since the expulsion force is in the form of an expanding gas, the pusher plate 32 is provided with an annular "O" ring 37 disposed within a recess so as to tightly seal across the cup member 30. "O" ring 38** likewise forms a sliding gas seal intermediate the cup member and the housing wall.

At some selected time, after firing, during its flight, the fuze in the fuze section 13 activates the charge of the expulsion cup 15 which thereupon generates sufficient gas pressure to drive the entire pusher assembly rearwardly with the payloads 25 and 35. In forcing the payload 25 against the base 20, the base plug shear pins 21 are severed and the plug base 20 is expelled with the payload 25 following immediately thereafter. In order to eject the additional payload 35 from the cup member 30, the rearward travel of the cup member is terminated by a plurality of stop pins 39 which are mounted in and extend inwardly from the housing 19 in a transverse plane located near the base plug 20. As shown in FIG. 3, four stop pins 39 extend into spaces between adjacent payload elements 25'. The cup member 30 is stopped when the stop pins 39 engage the outer periphery 40 of the shim **27*a* during the rearward travel of the pusher assembly. The pusher plate 32, since it is not attached to the cup member 30, continues its pushing of the payload 35 under gas pressure, shearing the peripheral portions of the shim 27*a* and pad 27*b*, and sliding within cup member 30, and is ejected from the housing 19 after the payload 35**.

Figure 5:
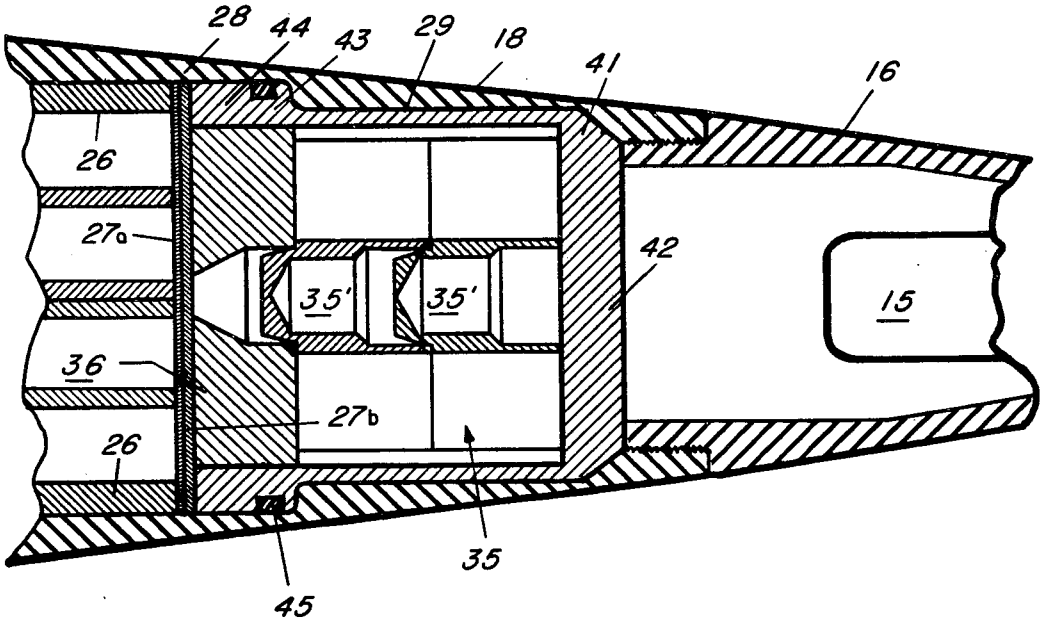
FIG. 5 is a fragmentary axial sectional view of an alternate embodiment illustrating the pusher ejection assembly.

In the alternate embodiment of FIG. 5, the pusher assembly is in the form of a cylindrical cup 41 with an integral bottom wall 42 closing across the opening in forward ogive 16. As in the first described embodiment, the rear portion or lip of the cup 41 is provided with a thick wall portion 43 which forms a bearing flange 44 and is formed with an annular recess in which is disposed sealing "O" ring 45. The operation is similar to that previously described except that the ogive payload 35 and holder 36 are expelled from cup 41 by their own momentum. It should also be noted that for this integral embodiment only one sealing member or "O" ring is necessary.

It should be understood, of course, that the foregoing disclosure relates to only preferred embodiments of the invention and that numerous modifications or alterations may be made therein without departing from the spirit and the scope of the invention as set forth in the appended claims.

What is claimed is:

1. A projectile for dispensing a payload at a selected point along its trajectory, comprising:

a housing including a forward ogive portion, a rear separatable base plug portion, and an intermediate hollow cylindrical portion filled with a first payload, an elongated hollow cylindrical pusher assembly means adjacent to said first payload and slidingly disposed substantially entirely within said ogive portion for movement rearwardly in said housing, with at least an annular portion of its peripheral wall in bearing contact with the inner wall of said housing, said pusher assembly means being open at its rear end and closed at the other end and filled with an additional payload, an expulsion charge means disposed within said ogive portion forward of said pusher assembly means for explosively generating an expanding gas, and fuze means for selectively activating said charge means;

whereby, upon activation of said charge means, said gas and said pusher assembly means will eject both of said payloads rearwardly from said housing.

2. The projectile according to claim 1 further including stop means on said housing for arresting the movement of a part of said assembly means short of said base plug.

3. The projectile according to claim 2 wherein said stop means are pins extending into said housing.

4. The projectile according to claim 3 wherein said part of said assembly means is a cup shaped member containing said additional payload, and said portion of said peripheral wall is an annular radially extending flange at said open end.

5. The projectile according to claim 4 wherein said flange is provided with an annular external recess having disposed therein an "O" ring.

6. The projectile according to claim 3 wherein said pusher assembly means includes a hollow cylindrical cup constituting said part and containing said additional payload, said cup having a restricted opening in its closed end, a pusher plate disc disposed within and across said cup end and having a reduced portion thereof extending into and closing said opening, plate sealing means slidingly sealing the peripheral edge of said disc to said cup.

7. The projectile according to claim 6, further comprising a plate-like member extending across said housing between said first payload and said cup, and adapted to be sheared by said stop means during ejection of said additional payload.

8. The projectile according to claim 6 further including means for limiting said first payload to axial travel without rotation during ejections from said housing.

9. The projectile according to claim 8 wherein said first payload comprises a multiplicity of axially-aligned, peripherally-spaced elements, and said limiting means comprises a series of axially-aligned spacers disposed between adjacent spaced elements and splined to said housing for axial movement only.

* * * * *